US011466478B2

(12) United States Patent
Anderson

(10) Patent No.: US 11,466,478 B2
(45) Date of Patent: Oct. 11, 2022

(54) SIDE IMPACT-INITIATED DOOR LATCH LOCKING SYSTEM

(71) Applicant: TOYOTA MOTOR ENGINEERING & MANUFACTURING NORTH AMERICA, INC., Plano, TX (US)

(72) Inventor: Chad E. Anderson, Ypsilanti, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 623 days.

(21) Appl. No.: 16/505,050

(22) Filed: Jul. 8, 2019

(65) Prior Publication Data

US 2021/0010302 A1 Jan. 14, 2021

(51) Int. Cl.
*E05B 77/04* (2014.01)
*E05B 77/12* (2014.01)

(52) U.S. Cl.
CPC ..... *E05B 77/12* (2013.01); *E05B 77/04* (2013.01)

(58) Field of Classification Search
CPC ..... E05B 77/12; E05B 77/04; E05B 85/10; E05B 85/12; E05B 85/16; E05B 85/18; Y10S 292/23; Y10S 292/65; Y10T 292/57
See application file for complete search history.

(56) References Cited

U.S. PATENT DOCUMENTS

| | | | | |
|---|---|---|---|---|
| 4,995,654 | A | 2/1991 | Nishigami et al. | |
| 6,065,797 | A | 5/2000 | Shirasaka | |
| 7,478,848 | B2 | 1/2009 | Kim | |
| 9,366,062 | B2 | 6/2016 | Kerr, III | |
| 9,605,449 | B2 | 3/2017 | Rosales et al. | |
| 10,068,393 | B2 | 9/2018 | Andrus | |
| 2010/0320777 | A1* | 12/2010 | Jankowski | E05B 77/42 292/200 |
| 2013/0146382 | A1* | 6/2013 | Schoen | E05B 79/12 180/281 |
| 2018/0073278 | A1* | 3/2018 | Lee | E05B 85/16 |
| 2019/0136583 | A1* | 5/2019 | Gray | E05B 77/04 |

FOREIGN PATENT DOCUMENTS

| | | | | |
|---|---|---|---|---|
| DE | 102017105973 | A1 | 9/2018 | |
| KR | 1020060067232 | A | 6/2006 | |
| KR | 100783964 | B1 * | 12/2007 | E05B 77/12 |
| KR | 20170019540 | A * | 2/2017 | |

OTHER PUBLICATIONS

Description Translation for KR 100783964 from Espacenet (Year: 2007).*

* cited by examiner

*Primary Examiner* — Jonathan Ng
*Assistant Examiner* — Daniel M. Keck
(74) *Attorney, Agent, or Firm* — Haynes and Boone, LLP

(57) ABSTRACT

Apparatuses and methods for preventing a vehicle door from opening in response to a side impact. An apparatus comprises a cover structure and a latch mechanism. The cover structure is located between an outer panel of a vehicle door and an inner panel of the vehicle door. The cover structure has an inboard surface with a sloped portion. The latch mechanism is associated with an inside handle that is attached to the inner panel of the vehicle door. Movement of the outer panel towards the inner panel causes the sloped portion of the inboard surface of the cover structure to contact the latch mechanism and move the latch mechanism into a latched position.

20 Claims, 7 Drawing Sheets

SIDE IMPACT-INITIATED DOOR LATCH LOCKING SYSTEM

FIELD

The present disclosure generally relates to a door latch locking system and, more particularly, to apparatuses, systems, and methods for locking an inside handle of a vehicle door in a latched position in response to an impact to the vehicle.

BACKGROUND

A vehicle impact event may have any number of undesired effects. An impact to a vehicle may cause a portion of the vehicle to deform inwards. For example, a side impact to a side of vehicle may cause that side to deform inwards. As a more specific example, a side impact may cause an outer panel of a vehicle door to deform inwards towards an inner panel of the vehicle door. The vehicle door may be a sliding door or some other type of door. In some cases, deformation of the outer panel of the vehicle door towards the inner panel affects an inside handle. For example, the inside handle may unlatch. This unlatching of the inside handle may increase the risk of the vehicle door opening during or after the side impact event.

SUMMARY

In one example embodiment, an apparatus comprises a cover structure and a latch mechanism. The cover structure is located between an outer panel of a vehicle door and an inner panel of the vehicle door. The cover structure has an inboard surface with a sloped portion. The latch mechanism is associated with an inside handle that is attached to the inner panel of the vehicle door. Movement of the outer panel towards the inner panel causes the sloped portion of the inboard surface of the cover structure to contact the latch mechanism and move the latch mechanism into a latched position.

In another example embodiment, a vehicle door comprises an outer panel, an inner panel, an inside handle attached to the inner panel, a cover structure, and a latch mechanism. The cover structure is located between the outer panel and the inner panel. The cover structure has an inboard surface with a sloped portion. The latch mechanism is associated with the inside handle. Movement of the outer panel towards the inner panel causes the sloped portion of the inboard surface of the cover structure to contact the latch mechanism and move the latch mechanism into a latched position.

In yet another example embodiment, a method is provided for preventing a vehicle door from opening in response to a side impact to the vehicle door. An outer panel of the vehicle door is moved in an inboard direction in response to the side impact to the vehicle door. The outer panel applies force to a cover structure located between the outer panel and an inner panel of the vehicle door such that a sloped portion of an inboard surface of the cover structure is moved in the inboard direction. The sloped portion of the inboard surface of the cover structure applies force to a latch mechanism associated with an inside handle attached to the inner panel to thereby move the latch mechanism into a latched position.

It is to be understood that both the foregoing general description and the following detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. In addition, the present disclosure may repeat reference numerals, letters, or both in the various examples. This repetition is for the purpose of simplicity and clarity and does not in itself dictate a relationship between the various embodiments and/or configurations discussed.

DETAILED DESCRIPTION

Figure 1:
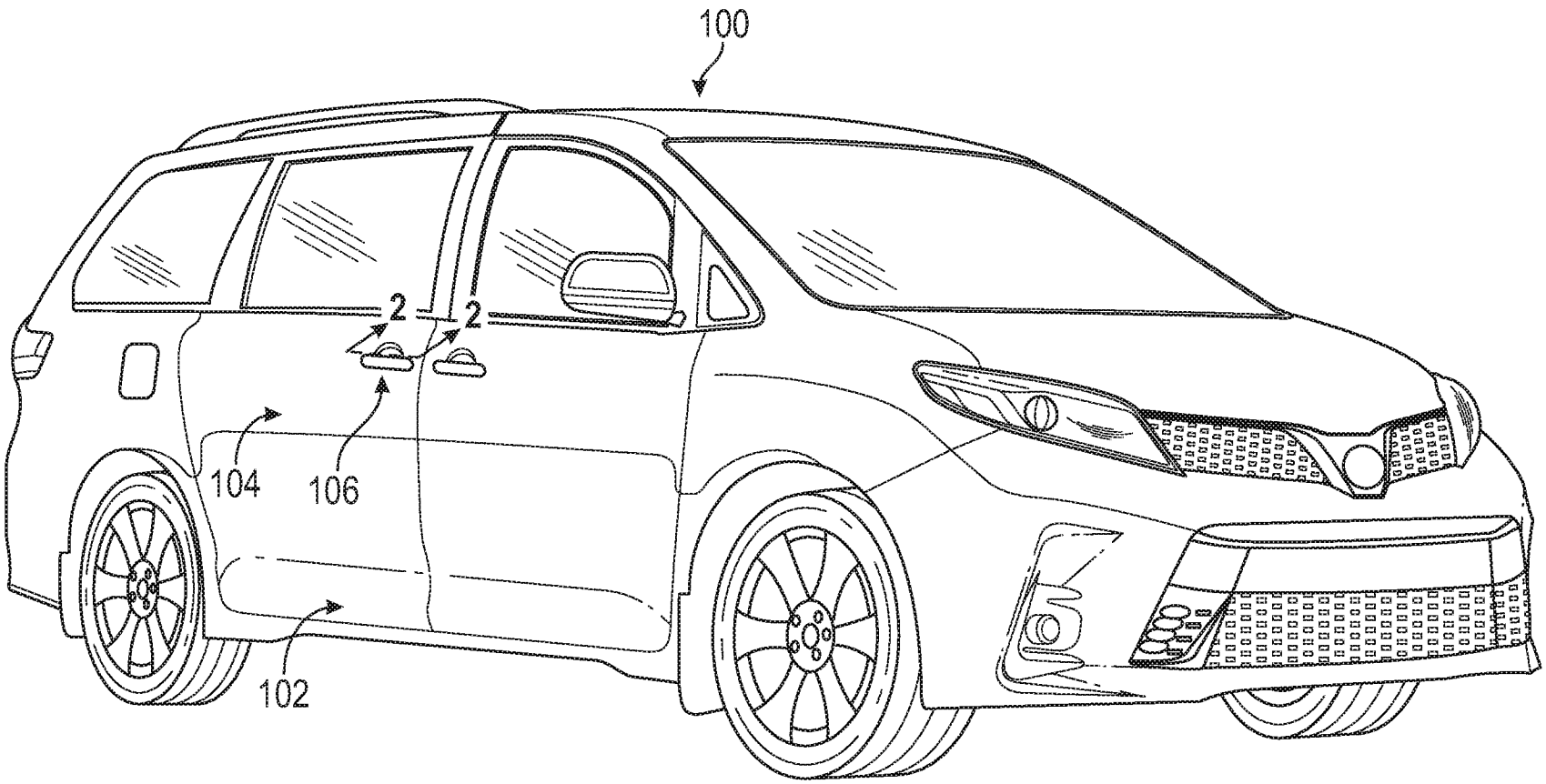
FIG. 1 is an illustration of a vehicle 100 in accordance with an example embodiment.

Illustrative embodiments and related methods of the present disclosure are described below as they might be employed in one or more apparatuses, systems, and methods for preventing a vehicle door from opening in response to an impact to the vehicle door. In the interest of clarity, not all features of an actual implementation or method are described in this specification. It will of course be appreciated that in the development of any such actual embodiment, numerous implementation specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure. Further aspects and advantages of the various embodiments and related methods of the disclosure will become apparent from consideration of the following description and drawings.

The example embodiments described below describe apparatuses, systems, and methods for preventing a vehicle door from opening during or after a side impact to the vehicle door. The vehicle door may be a sliding door having an outer panel and an inner panel. An outside handle may be attached to the outer panel and an inside handle may be attached to the inner panel. In the event of a side impact to the vehicle door, the outer panel may deform inwards. A latch locking system is used to prevent or increase the time it takes for the outer panel to directly contact the inner panel or "stroke" the inside handle attached to the inner panel. The latch locking system moves a latch mechanism (e.g., a lever) into a latched position to lock the inside handle. In this manner, the latch locking system provides a fast and efficient response to a side impact to the vehicle door to prevent the vehicle door from opening.

In one or more example embodiments, apparatuses, systems, and methods are provided for preventing a vehicle door from opening in response to a side impact to the vehicle door. An outer panel of the vehicle door is moved in an inboard direction in response to the side impact to the vehicle door. For example, the side impact may cause the outer panel to deform inwards. This deformation causes the outer panel to apply force to a cover structure located between the outer panel and an inner panel of the vehicle door such that a sloped portion of an inboard surface of the cover structure is moved in the inboard direction. The sloped portion of the inboard surface of the cover structure applies force to a latch mechanism associated with an inside handle attached to the inner panel to thereby move the latch mechanism into a latched position. For example, the sloped portion contacting the latch mechanism and applying force to the latch mechanism may cause the latch mechanism to rotate into the latched position. When the latch mechanism is in the latched position, the vehicle door is prevented from opening.

Referring now to the figures, FIG. 1 is an illustration of a vehicle 100 in accordance with an example embodiment. Vehicle 100 is depicted as a minivan in this illustrative example. But in other example embodiments, vehicle 100 may be a van, a multipurpose vehicle, a sports utility vehicle, or some other type of vehicle. Vehicle 100 has vehicle door 102. In this example embodiment, vehicle door 102 is a sliding door. But in other example embodiments, vehicle door 102 may be some other type of door. Vehicle door 102 has outer panel 104 and outside handle 106 that is attached to outer panel 104. Outside handle 106 may also be referred to as an outside door handle or an outer door handle.

Vehicle door 102 also includes an inside handle (not shown in this view) and a latch locking system (not shown in this view). The latch locking system prevents or reduces the possibility of the inside handle being unlatched and vehicle door 102 opening, in the event of an impact (e.g., a side impact) to vehicle door 102. The latch locking system may include at least a portion of a cover structure and a latch mechanism.

Figure 2:
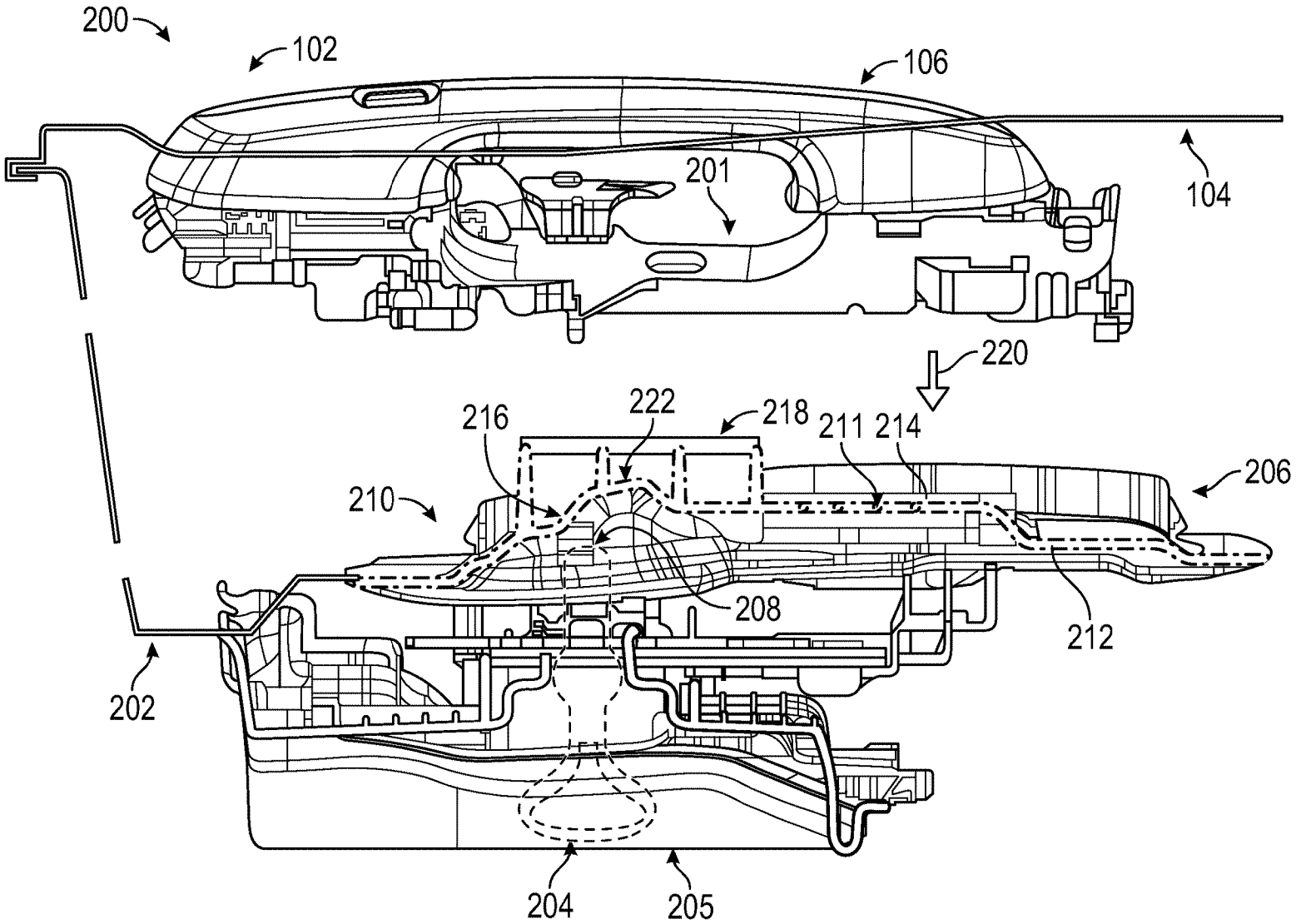
FIG. 2 is a schematic illustration of an exploded, cross-sectional top view of a portion of the vehicle door from FIG. 1 in accordance with an example embodiment.

FIG. 2 is a schematic illustration of an exploded, cross-sectional top view of a portion 200 of vehicle door 102 from FIG. 1 in accordance with an example embodiment. This exploded, cross-sectional top view is taken with respect to lines 2-2 in FIG. 1. As described above, vehicle door 102 includes outer panel 104 and outside handle 106 attached to outer panel 104. In particular, outside handle 106 is attached to outer structure 201, which is associated with outer panel 104. Outer structure 201 may include any number of plates, brackets, fasteners, shaped members, other types of structural elements, or combination thereof.

As used herein, when one component is "associated" with another component, the association is a physical association. For example, a first component, such as outer structure 201, may be considered to be associated with a second component, such as outer panel 104, by being at least one of secured to the second component, bonded to the second component, mounted to the second component, welded to the second component, fastened to the second component, or connected to the second component in some other suitable manner. The first component also may be connected to the second component using a third component. Further, the first component may be considered to be associated with the second component by being formed as or integrated as part of the second component.

Vehicle door 102 further includes inner panel 202 and inside handle 204 attached to inner panel 202. In particular, inside handle 204 is attached to inner structure 205, which is associated with inner panel 202. Inner structure 205 may include any number of plates, brackets, fasteners, shaped members, other types of structural elements, or combination thereof. In this view, inside handle 204 is not visible as it is hidden by inner structure 205, but inside handle 204 is shown in phantom view in FIG. 2 via dashed line. Inside handle 204 may also be referred to as an inside door handle or inner door handle.

Vehicle door 102 also includes cover structure 206 and latch mechanism 208. In one or more example embodiments, cover structure 206 and latch mechanism 208 form latch locking system 210. In some examples, latch locking system 210 includes only a portion of cover structure 206. Cover structure 206 is located between outer panel 104 and inner panel 202. In one or more example embodiments, cover structure 206 is used to cover a number of service holes 211 in inner panel 202. The number of service holes 211 may include one or more service holes. These service holes 211 are covered to prevent water, noise, dirt, debris, other types of fluids or particulates, or a combination thereof from entering vehicle 100.

In these example embodiments, cover structure 206 is associated with inner panel 202. Cover structure 206 has inboard surface 212 at an inboard side of cover structure 206 and outboard surface 214 at an outboard side of cover structure 206. Inboard surface 212 includes sloped portion 216. Sloped portion 216 may be sloped in an inboard-outboard direction (or outboard-inboard direction). In other words, sloped portion 216 may be sloped with respect to a vertical plane between inner panel 202 and outer panel 104.

Optionally, rib structure 218 is associated with cover structure 206. Rib structure 218 provides rigidity to cover structure 206. Further, rib structure 218 is used to reduce the gap between outer panel 104 and inner panel 202.

Latch mechanism 208 is associated with inside handle 204. Latch mechanism 208 may be moved between a latched position and an unlatched position to thereby move inside handle 204 between a locked state and an unlocked state, respectively. When latch mechanism 208 is in the latched position, vehicle door 102 from FIG. 1 is prevented from being opened. When latch mechanism 208 is in the unlatched position, vehicle door 102 may be opened. For example, when vehicle door 102 is a sliding door, vehicle door 102 may be easily slid open with latch mechanism 208 is in the unlatched position. In one example embodiment, latch mechanism 208 takes the form of a lever.

In the event of a side impact to vehicle door 102, outer panel 104 may move inwards in inboard direction 220. For example, outer panel 104 may deform in inboard direction 220. This movement or deformation of outer panel 104 in inboard direction 220 causes outer panel 104 to contact rib structure 218 and apply force to rib structure 218. Rib structure 218, in turn, applies force to cover structure 206, which causes cover structure 206 to move in inboard direction 220. In this manner, movement of outer panel 104 in inboard direction 220 causes outer panel 104 to indirectly apply force to cover structure 206.

When cover structure 206 moves in inboard direction 220, cover structure 206 contacts latch mechanism 208 and applies force to latch mechanism 208. In particular, sloped portion 216 of cover structure 206 contacts and applies force to latch mechanism 208. This application of force causes latch mechanism 208 to move into the latched position. Sloped portion 216 is shaped to ensure contact with latch mechanism 208 in a way that will cause latch mechanism 208 to move into the latched position. In these example embodiments, when viewed from a top view, sloped portion 216 appears angled between outer panel 104 and inner panel 202, as shown by contour line 222. Contour line 222 represents a horizontal cross-section of the contour of inboard surface 212 along a plane at which sloped portion 216 would contact latch mechanism 208 when curved structure 206 moves inwards.

With latch mechanism 208 in the latched position, inside handle 204 is locked. In this manner, cover structure 206 moving in inboard direction 220 causes inside handle 204 to lock, thereby preventing vehicle door 102 from being opened during or after the side impact event. The rigidity and stability provided by rib structure 218 to cover structure 206 helps ensure that cover structure 206 does not deform in an undesired manner before contact with latch mechanism 208 is made and force is applied to latch mechanism 208. Rib structure 218 helps ensure that sufficient force is applied to latch mechanism 208 to move latch mechanism 218 into the latched position.

In some example embodiments, rib structure 218 is not associated with cover structure 206. When rib structure 218 is not present, movement of outer panel 104 in inboard direction 220 causes outer panel 104 to directly contact and apply force to cover structure 206.

Figure 3:
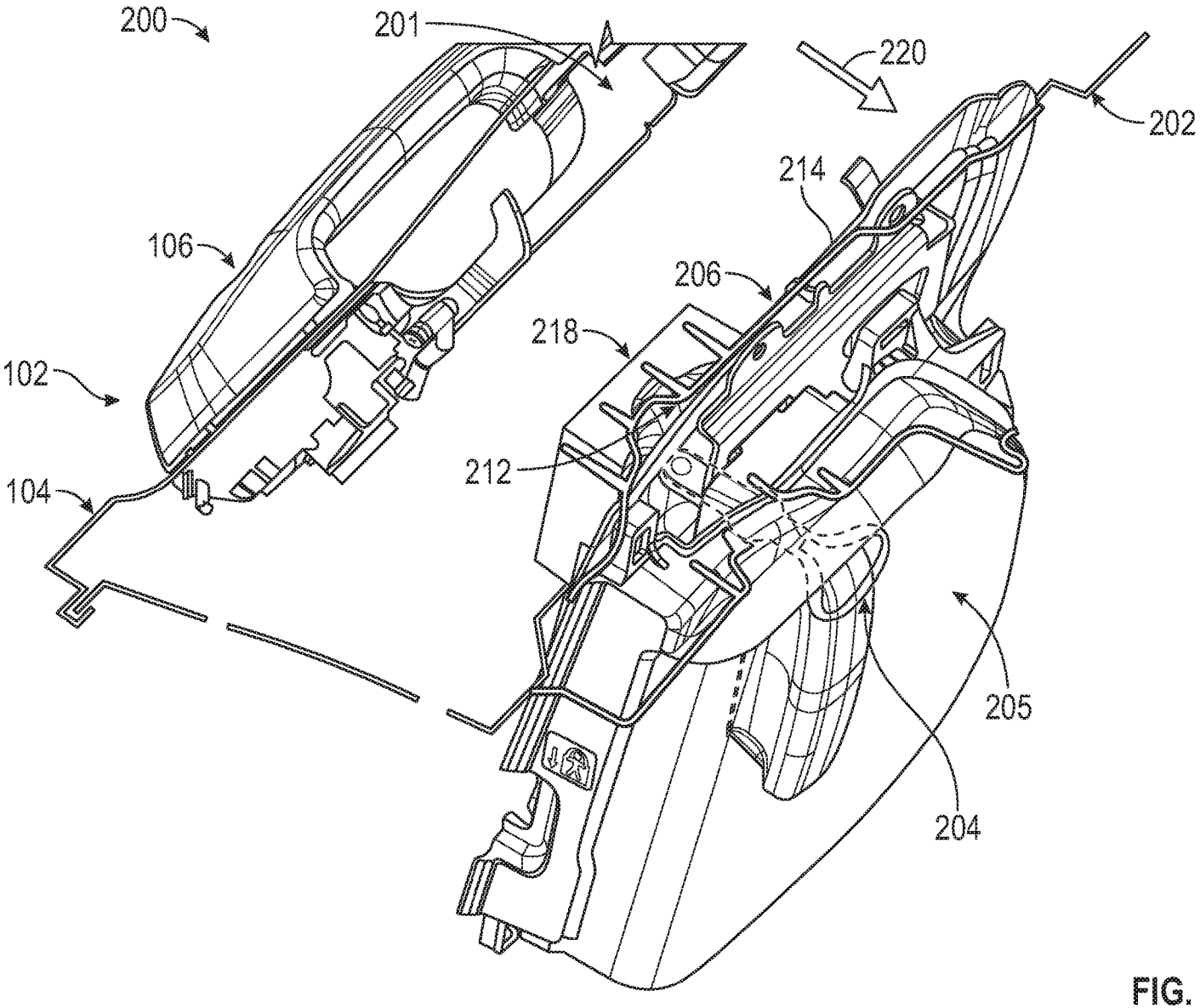
FIG. 3 is a schematic illustration of perspective view of the portion of the vehicle door from FIG. 2 in accordance with an example embodiment.

FIG. 3 is a schematic illustration of a perspective view of portion 200 of vehicle door 102 from FIG. 2 in accordance with an example embodiment. Inside handle 204 is more clearly seen in this illustrative example.

Figure 4:
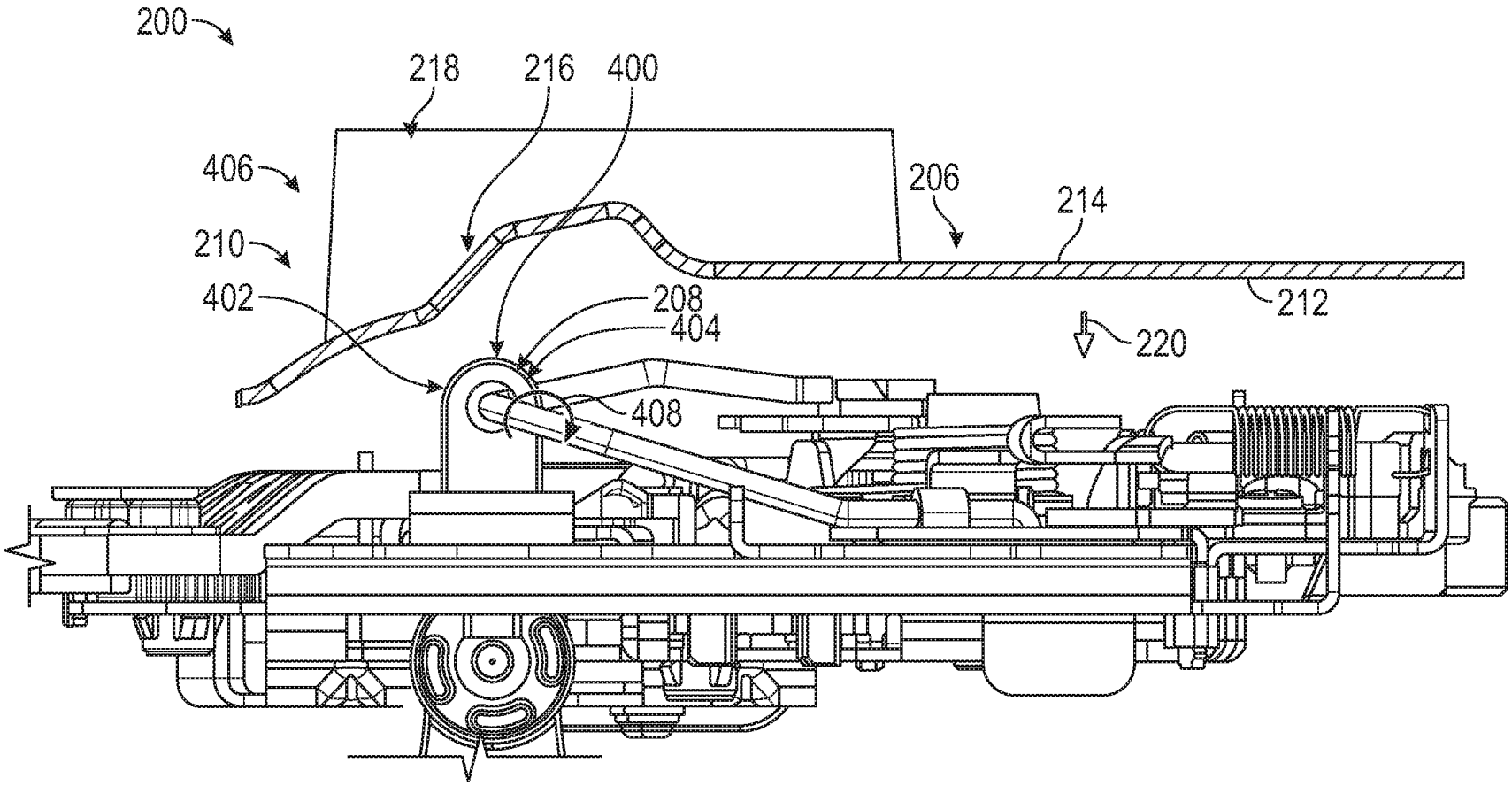
FIG. 4 is a schematic illustration of a top view of a cover structure and a latch mechanism in a first state in accordance with an example embodiment.

FIG. 4 is a schematic illustration of cover structure 206 and latch mechanism 208 from FIG. 2 in a first state in accordance with an example embodiment. Latch mechanism 208 is more clearly seen in this view. Latch mechanism 208 has end 400. End 400 has first side 402 and second side 404. In this example embodiment, cover structure 206 and latch mechanism 208 are shown in first state 406. In first state 406, a gap is present between cover structure 206 and latch mechanism 208.

When a side impact event occurs, as described above, outer panel 104 from FIGS. 2-3 may be deformed and moved in inboard direction 220. Outer panel 104 may contact rib structure 218 and thereby indirectly apply force to cover structure 206, causing cover structure 206 to move in inboard direction 220. Movement of cover structure 206 in inboard direction 220 causes cover structure 206 to contact latch mechanism 208 and move latch mechanism 208.

In particular, sloped portion 216 of cover structure 206 contacts first side 402 of end 400 of latch mechanism 208 and applies force to first side 402. In some example embodiments, end 400 is a curved end or at least first side 402 of end 400 is a curved end. In other example embodiments, end 400 is a square end, a triangular end, or an end shaped in some other manner. The shape of end 400 is selected to ensure a desired contact between end 400 and sloped portion 216 of cover structure 206 when cover structure moves inwards such that latch mechanism 208 is moved into a latched position. In other words, end 400 is shaped to ensure that when cover structure 206 moves inwards in inboard direction 220, sloped portion 216 forces latch mechanism 208 into the latched position.

For example, the movement of cover structure 206 in inboard direction 220 may forcibly rotate latch mechanism 208 in the direction of arrow 408. In other words, sloped portion 216 of inboard surface 212 of cover structure 206 is shaped such that when sloped portion 216 contacts end 400 of latch mechanism 208, latch mechanism 208 is rotated into the latched position. In other example embodiments, sloped portion 216, end 400, or both may be shaped in some other manner.

Figure 5:
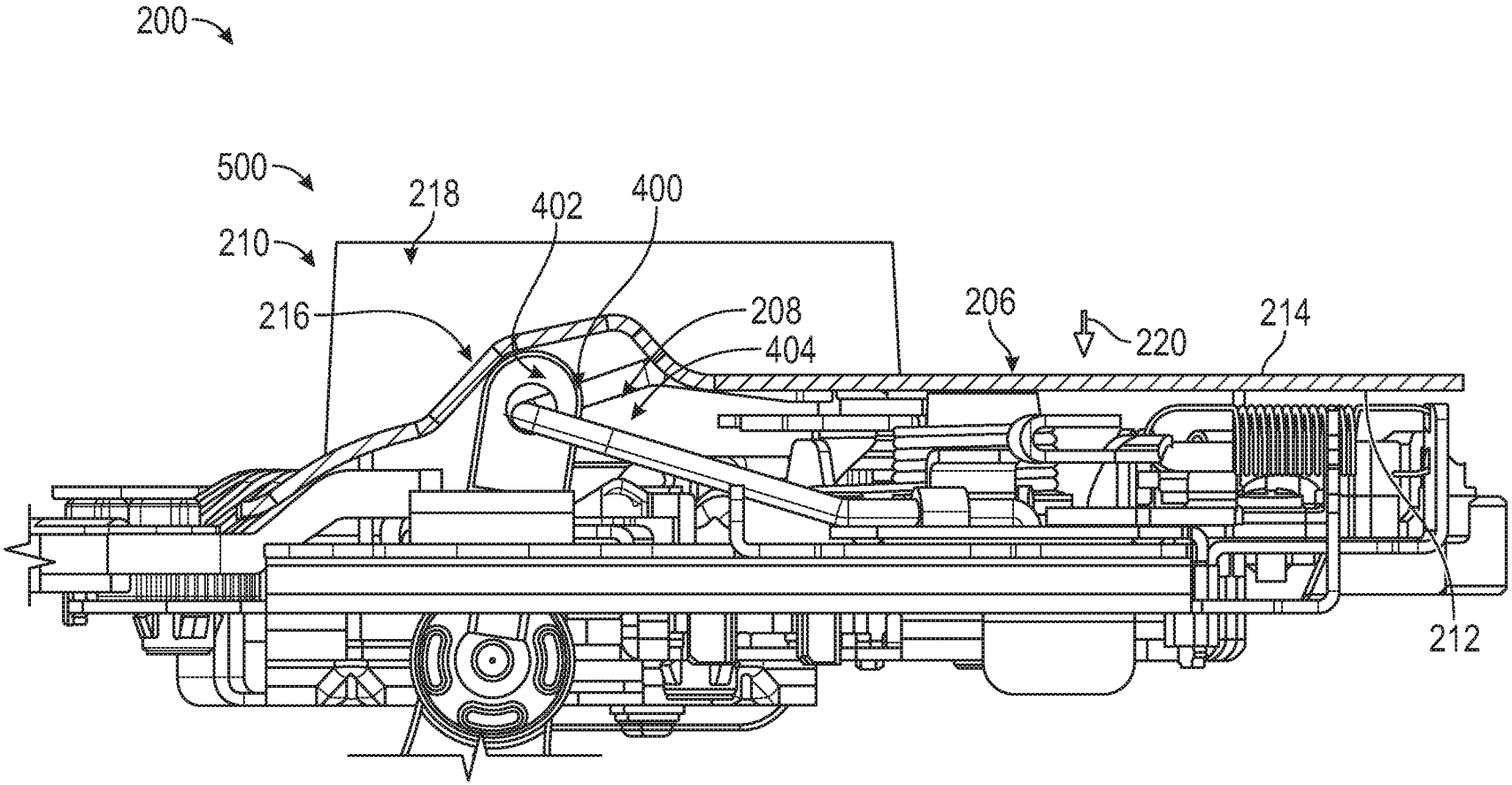
FIG. 5 is a schematic illustration of a top view of a cover structure and a latch mechanism in a second state in accordance with an example embodiment.

FIG. 5 is a schematic illustration of cover structure 206 and latch mechanism 208 from FIG. 4 in a second state in accordance with an example embodiment. In FIG. 5, cover structure 206 is shown moved into second state 500, in which latch mechanism 208 has been moved into the latched position. In these example embodiments, sloped portion 216 is shaped such that when cover structure 206 is in second state 500, latch mechanism 208 is prevented from moving back into the unlatched position.

Figure 6:
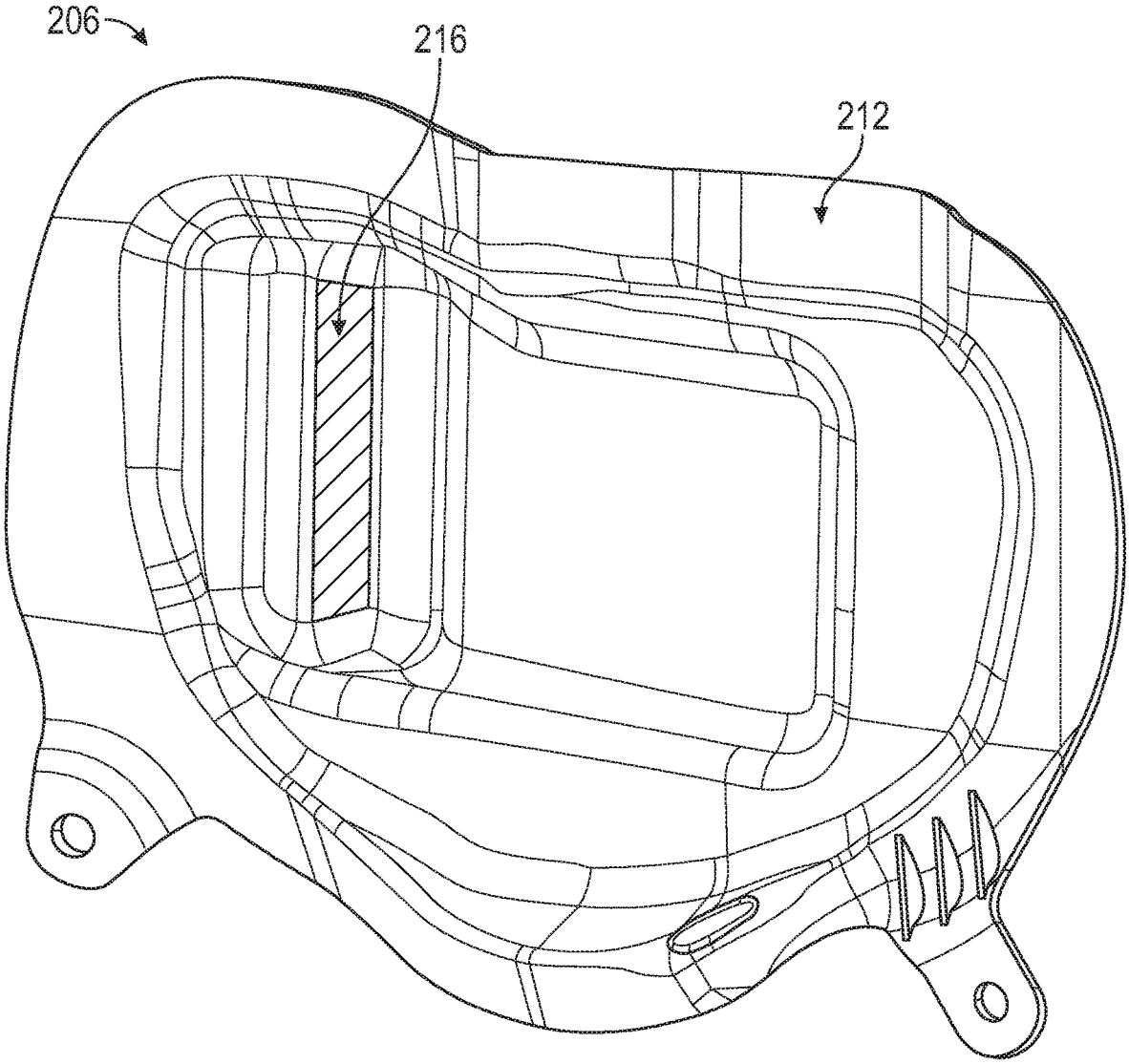
FIG. 6 is a schematic illustration of a perspective view of a cover structure in accordance with an example embodiment.

FIG. 6 is a schematic illustration of a perspective view of cover structure 206 in accordance with an example embodiment. In this view, inboard surface 212 of cover structure 206 may be more clearly seen. Further, sloped portion 216 of inboard surface 212 of cover structure 206 may be more clearly seen.

In other example embodiments, sloped portion 216 of inboard surface 212 may be replaced with some other shaped portion. This other shaped portion may be shaped in any manner that ensures contact with latch mechanism 208, as described above, when cover structure 206 is moved inboard such that latch mechanism 208 is forced to move or rotate into the latched position. For example, the shaped portion may be complexly shaped or contoured with only a smaller portion sloped to make contact with latch mechanism 208. In some example embodiments, the shaped portion may be curved.

Figure 7:
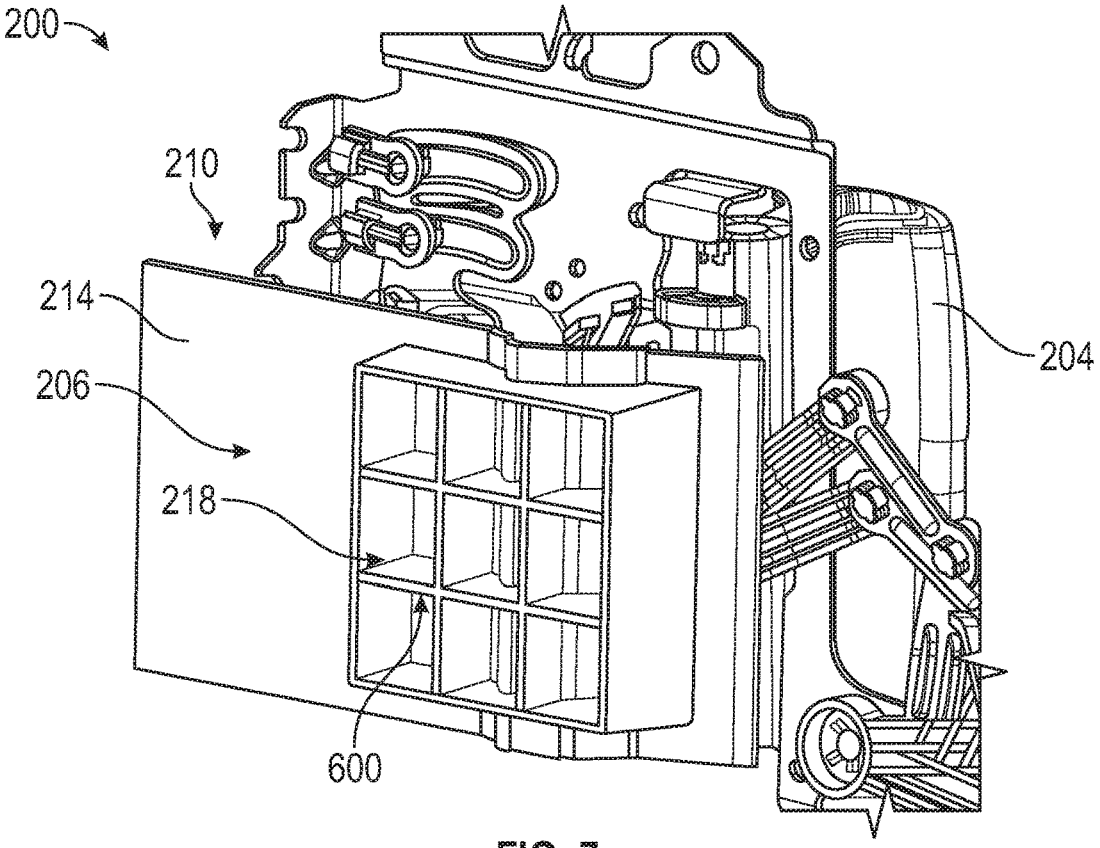
FIG. 7 is a schematic illustration of a different view of the cover structure from FIGS. 4-5 in accordance with an example embodiment.

FIG. 7 is a schematic illustration of a different view of cover structure 206 from FIGS. 4-5 in accordance with an example embodiment. In FIG. 7, rib structure 218 is more clearly seen. Rib structure 218 includes ribs 700. Ribs 700 provide rigidity to cover structure 206. In these example embodiments, rib structure 218 is used to reduce a time needed for outer panel 104 to contact and apply force to cover structure 206. Specifically, rib structure 218 reduces the distance that outer panel 104 needs to deform in the inboard direction before reaching the point at which force is applied to cover structure 206.

Figure 8:
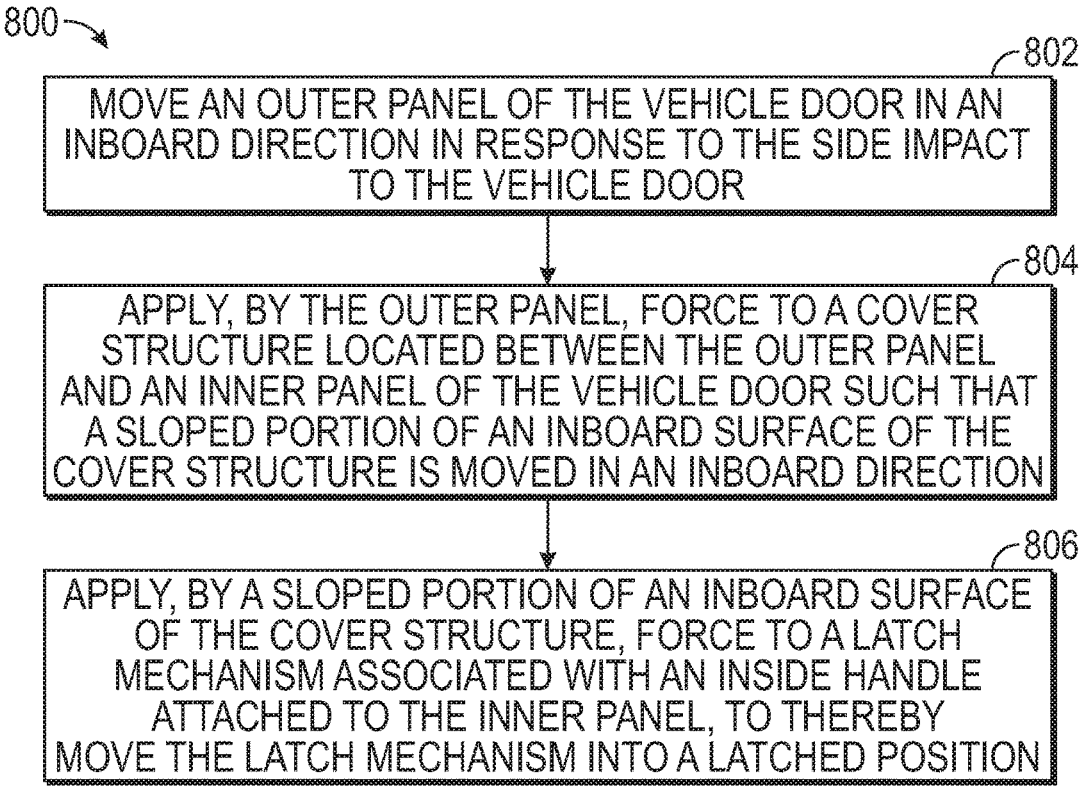
FIG. 8 is a flowchart of a method for preventing a vehicle door from opening in response to a side impact to the vehicle door in accordance with an example embodiment.

FIG. 8 is a flowchart of a method 800 for preventing a vehicle door from opening in response to a side impact to the vehicle door in accordance with an example embodiment. Method 800 is illustrated as a set of operations or steps 802 through 806 and is described with continuing reference to FIG. 1. One or more steps that are not expressly illustrated in FIG. 8 may be included before, after, in between, or as part of the steps 802 through 806. In one or more embodiments, the steps 802 through 806 may be performed to prevent vehicle door 102 in FIG. 1 from opening during or after a side impact event.

Method 800 may begin by moving an outer panel of a vehicle door in an inboard direction in response to a side impact to the vehicle door (step 802). In particular, at step 802, the side impact may cause the outer panel to deform inwards. Movement or deformation of the outer panel in the inboard direction results in the outer panel contacting a cover structure located between the outer panel and an inner panel of the vehicle door.

The outer panel applies force to the cover structure located between the outer panel and the inner panel of the vehicle door such that a sloped portion of an inboard surface of the cover structure is moved in an inboard direction (step 804). At step 804, the outer panel may apply the force to the cover structure directly or indirectly. In some example embodiments, the outer panel applies the force to a rib structure associated with the cover structure to thereby apply the force to the cover structure. The rib structure may be used to provide rigidity to the cover structure. Further, the rib structure may be used to reduce a time needed for the outer panel to apply the force to the cover structure. In particular, the rib structure reduces the distance that the outer panel needs to deform in the inboard direction before reaching the point at which force is applied to the cover structure.

The sloped portion of the inboard surface of the cover structure applies force to a latch mechanism associated with an inside handle attached to the inner panel to thereby move the latch mechanism into a latched position (step 806). In some example embodiments, at step 806, the sloped portion contacts the latch mechanism in such a manner that the latch mechanism is forcibly rotated into the latched position. With the latch mechanism in the latched position, the inner handle is locked, and the vehicle door is prevented from opening. Thus, method 800 ensures that in the event of a side impact to the vehicle door, the vehicle door is prevented from opening or the possibility of the vehicle door opening is reduced.

Thus, the different example embodiments described above provide apparatuses, systems, and methods for preventing a vehicle door from opening in response to a side impact to the vehicle door. The example embodiments described above provide a safe, simple, and efficient system for locking an inner handle of a vehicle door in response to an impact to the vehicle, such as a side impact to the vehicle door. The example embodiments describe a latch locking system that may be integrated with components already used in the vehicle door to reduce the cost associated with retrofitting such a vehicle door or manufacturing such a vehicle door. For example, cover structure 206 described above in FIGS. 2-7 may take the place of existing covers that are used to cover service holes in inner panels.

While certain exemplary embodiments of the invention have been described and shown in the accompanying drawings, it is to be understood that such embodiments are merely illustrative of and not restrictive on the broad invention, and that the embodiments of the invention not be limited to the specific constructions and arrangements shown and described, since various other modifications may occur to those ordinarily skilled in the art. The intention is to cover all modifications, equivalents and alternatives falling within the spirit and scope of the disclosure as defined by the claims.

What is claimed is:

1. An apparatus comprising:

a cover structure located between an outer panel of a vehicle door and an inner panel of the vehicle door, the cover structure having an inboard surface with a sloped portion; and a latch mechanism associated with an inside handle that is attached to the inner panel of the vehicle door, wherein movement of the outer panel towards the inner panel causes the sloped portion of the inboard surface of the cover structure to contact the latch mechanism and move the latch mechanism into a latched position.

2. The apparatus of claim 1, further comprising:

the inner panel of the vehicle door, wherein the inside handle is rigidly attached to the inner panel; and the outer panel of the vehicle door.

3. The apparatus of claim 1, wherein the cover structure is associated with the inner panel and used to cover a number of service holes in the inner panel.

4. The apparatus of claim 3, wherein the cover structure is associated with the inner panel by being either integrated as part of or attached to the inner panel.

5. The apparatus of claim 1, wherein the latch mechanism is associated with the inside handle by being either integrated as part of or attached to the inside handle.

6. The apparatus of claim 1, wherein the sloped portion of the inboard surface of the cover structure is shaped such that when the sloped portion contacts the latch mechanism, the latch mechanism is rotated into the latched position.

7. The apparatus of claim 1, wherein the latch mechanism is a lever associated with the inside handle.

8. The apparatus of claim 1, further comprising:

a rib structure positioned at an outboard side of the cover structure, wherein the movement of the outer panel towards the inner panel causes the outer panel to contact and apply force to the rib structure, which thereby causes the rib structure to apply force to the cover structure, which thereby causes the sloped portion of the inboard surface of the cover structure to move the latch mechanism into the latched position.

9. The apparatus of claim 8, wherein the rib structure is a rigid structure that provides increased rigidity at a point at which the cover structure contacts the latch mechanism and wherein the rib structure reduced a time needed for the outer panel to contact and apply the force to the cover structure.

10. The apparatus of claim 1, wherein the latch mechanism is a lever having a curved end and wherein the sloped portion of the inboard surface of the cover structure is shaped such that the sloped portion contacts and applies force to a first side of the curved end.

11. The apparatus of claim 1, wherein the sloped portion of the inboard surface of the cover structure is sloped in an inboard-outboard direction.

12. The apparatus of claim 1, wherein the outer panel deforms and moves towards the inner panel in response to a side impact to the vehicle door.

13. The apparatus of claim 1, wherein the cover structure is shaped to prevent the latch mechanism from moving back into the unlatched position.

14. The apparatus of claim 1, wherein the vehicle door is a sliding door.

15. A vehicle door comprising:

an outer panel;

an inner panel;

an inside handle attached to the inner panel;

a cover structure located between the outer panel and the inner panel, the cover structure having an inboard surface with a sloped portion; and a latch mechanism associated with the inside handle, wherein movement of the outer panel towards the inner panel causes the sloped portion of the inboard surface of the cover structure to contact the latch mechanism and move the latch mechanism into a latched position.

16. The vehicle door of claim 15, further comprising:

a rib structure positioned at an outboard side of the cover structure, wherein the movement of the outer panel towards the inner panel causes the outer panel to contact and apply force to the rib structure, which thereby causes the rib structure to apply force to the cover structure, which thereby causes the sloped portion of the inboard surface of the cover structure to move the latch mechanism into the latched position.

17. A method for preventing a vehicle door from opening in response to a side impact to the vehicle door, the method comprising:

moving an outer panel of the vehicle door in an inboard direction in response to the side impact to the vehicle door;

applying, by the outer panel, force to a cover structure located between the outer panel and an inner panel of the vehicle door such that a sloped portion of an inboard surface of the cover structure is moved in an inboard direction; and applying, by the sloped portion of the inboard surface of the cover structure, force to a latch mechanism associated with an inside handle attached to the inner panel to thereby move the latch mechanism into a latched position.

18. The method of claim 17, wherein applying the force to the latch mechanism comprises:

rotating the latch mechanism into the latched position, wherein the vehicle door is prevented from opening with the latch mechanism in the latched position.

19. The method of claim 17, wherein applying the force to the cover structure comprises:

applying the force to a rib structure associated with the cover structure to thereby apply the force to the cover structure, wherein the rib structure provides rigidity to the cover structure and reduces a time needed for the outer panel to apply the force to the cover structure.

20. The method of claim 17, wherein the outer panel moves in the inboard direction by deforming inwards towards the inner panel.

* * * * *